US007151516B2

(12) United States Patent
Takeda et al.

(10) Patent No.: US 7,151,516 B2
(45) Date of Patent: Dec. 19, 2006

(54) LIQUID CRYSTAL DISPLAY DEVICE

(75) Inventors: Hiroshi Takeda, Kanagawa (JP); Youji Hirano, Kanagawa (JP)

(73) Assignee: NEC LCD Technologies, Ltd. (JP)

( * ) Notice: Subject to any disclaimer, the term of this patent is extended or adjusted under 35 U.S.C. 154(b) by 438 days.

(21) Appl. No.: 10/632,713

(22) Filed: Aug. 1, 2003

(65) Prior Publication Data

US 2004/0041773 A1 Mar. 4, 2004

(30) Foreign Application Priority Data

Aug. 2, 2002 (JP) ..... 2002-226440

(51) Int. Cl.
*G09G 3/36* (2006.01)

(52) U.S. Cl. ..... 345/87; 345/98

(58) Field of Classification Search ..... 345/87–100, 345/211, 212, 204, 210
See application file for complete search history.

(56) References Cited

U.S. PATENT DOCUMENTS 5,831,605 A * 11/1998 Yasui et al. ..... 345/211
6,812,911 B1 * 11/2004 Makishima et al. ..... 345/211

FOREIGN PATENT DOCUMENTS

| | | | |
|---|---|---|---|
| JP | 10-293559 | * | 4/1998 |
| JP | 10-293559 | | 11/1998 |
| JP | 2001-312257 | | 9/2001 |
| JP | 2002-041003 | | 8/2002 |

* cited by examiner

*Primary Examiner*—Regina Liang
(74) *Attorney, Agent, or Firm*—Hayes Soloway P.C.

(57) ABSTRACT

An active matrix liquid crystal display device operates such that the polarity of a voltage on a common electrode 30 is inverted by row or by frame. A charge collection/resupply circuit includes a switch connected between the common electrode and a common voltage output buffer, a charge collection capacitor, and a switch connected between a connection point of the common electrode and the switch and the charge collection capacitor. The switch control unit is configured to operate such that immediately before a polarity of a common voltage VCOM10 is inverted, the switch 11 is turned off and then the switch 12 is turned on, and further, after inversion of the polarity of the common voltage VCOM, the switch is turned off and then the switch is turned on.

8 Claims, 6 Drawing Sheets

LIQUID CRYSTAL DISPLAY DEVICE

BACKGROUND OF THE INVENTION

1. Technical Field of the Invention

The present invention relates to a liquid crystal display device intentionally and preferably designed to reduce power consumption during operation for driving liquid crystal display elements.

2. Description of the Related Art

Recently, an active matrix liquid crystal display device used as a portable terminal monitor has been increasingly required to reduce power consumption during its operation. To date, reduction in power consumption of liquid crystal display device has been made possible such as by reducing power consumption of driver IC and/or improving the efficiency of operation of power supply IC. However, the above-described improvement efforts are now becoming inefficient and therefore, power consumption during operation for driving a liquid crystal panel needs to be reduced.

For example, Japanese Patent Laid-Open No. 10(1998)-293559 discloses a liquid crystal display device configured to reduce power consumption during operation for driving a liquid crystal panel. The conventional liquid crystal display device disclosed in this publication operates such that immediately before the polarity of a voltage on a common electrode is inverted, electric charge accumulated in a liquid crystal display element is collected as a collection voltage having the same polarity as the voltage on the common electrode and supplied to the liquid crystal display element at the time the polarity of the voltage on the common electrode becomes the same as that of the collection voltage. The liquid crystal display element acts as a capacitor and discharges current generated when the polarity of a terminal voltage across the liquid crystal display element is inverted. The energy generated is stored in a coil, and the current generated by discharge from the coil is rectified. Then electric charge accumulated in the capacitor upon activation of the liquid crystal display element is collected as a voltage having the same polarity as the voltage on the common electrode by a capacitor of a charge collection circuit. The electric charge collected by the capacitor is again supplied (re-supplied) to the liquid crystal display element at the time the common electrode is driven to a voltage with the same polarity as the collection voltage.

However, the conventional technique disclosed in the publication has the following drawbacks. That is, the liquid crystal display device according to the conventional technique basically operates such that energy generated when the common voltage VCOM is changed is stored in the coil via a capacitor (capacitor between a pixel electrode and a common electrode) of the liquid crystal display element as and current generated by discharge from the coil is rectified and accumulated in a collection capacitor, resulting in reuse of the electric charge. However, since capacitance associated with the common electrode (i.e., capacitance between a common electrode and a gate electrode, between a common electrode and a drain electrode, and between a common electrode and the ground, and further including stray capacitances) is large, change in voltage between both terminals of the coil becomes smaller, unfavorably resulting in lowering of collection ratio of electric charge within the liquid crystal display device.

Furthermore, since a voltage to be applied to the pixel electrode is applied thereto via the drain electrode and then a TFT, a time constant of the voltage becomes large and accordingly, change per time in voltage between both terminals of the coil becomes small, unfavorably resulting in lowering of collection ratio of energy within the liquid crystal display device.

SUMMARY OF THE INVENTION

It is an object of the present invention to provide an active matrix liquid crystal display device being suitable for use in a portable terminal monitor as a display device and configured to collect electric charge to be accumulated in a capacitor associated with the common electrode without utilizing a capacitor and a TFT of a liquid crystal display element, and resupplying the collected charge to the common electrode, and thus significantly reducing power consumption during device operation.

A liquid crystal display device according to a first aspect of the present invention is an active matrix liquid crystal display device configured to invert a polarity of a voltage on a common electrode by row or by frame and including: a common voltage supply circuit provided to supply a common voltage VCOM10 to the common electrode; and a charge collection and resupply circuit connected between the common electrode and the common voltage supply circuit, in which the charge collection and resupply circuit includes: a first switch connected between the common electrode and the common voltage supply circuit; a charge collection capacitor; a second switch connected between a connection point of the common electrode and the first switch and the charge collection capacitor; a switch control unit provided to control turning on and off of the first and second switches. In this case, the switch control unit is configured to operate such that immediately before a polarity of the common voltage VCOM10 is inverted, the first switch is turned off and then the second switch is turned on, and further, after inversion of the polarity of the common voltage VCOM10, the second switch is turned off and then the first switch is turned on.

A liquid crystal display device according to a second aspect of the present invention is an active matrix liquid crystal display device configured to invert a polarity of a voltage on a common electrode by row or by frame and including: a common voltage supply circuit provided to supply a common voltage VCOM10 to the common electrode; and a charge collection and resupply circuit connected between the common electrode and the common voltage supply circuit, in which the charge collection and resupply circuit includes: a first switch connected between the common electrode and the common voltage supply circuit; a positive charge collection capacitor; a negative charge collection capacitor; a second switch connected between a connection point of the common electrode and the first switch and the positive charge collection capacitor; a third switch connected between the connection point and ground; a fourth switch connected between the connection point and the negative charge collection capacitor; and a switch control unit provided to control turning on and off of the first through fourth switches. In this case, the switch control unit is configured to operate such that immediately before a polarity of the common voltage VCOM10 is inverted from a positive polarity to a negative polarity, the first switch is turned off and then the second switch is turned on and held in an on-state during a specific period of time, and then, the polarity is inverted while the third switch is being in an on-state during a specific period of time, and subsequently, after the fourth switch is being in an on-state during a specific period of time, the first switch is turned on, and immediately before the common voltage VCOM10 is inverted from a negative polarity to a positive polarity, the first switch is turned off and then the fourth switch is turned on and held in an on-state during a specific period of time, and then, the polarity is inverted while the third switch is being in an on-state during a specific period of time, and thereafter, the second switch is turned on and held in an on-state during a specific period of time and then the first switch is turned on.

The liquid crystal display device according to the above-stated first and second aspects of the invention may further includes a DC level shift circuit provided to invert a polarity of a common voltage and disposed in a stage prior to the charge collection and resupply circuit or in a stage subsequent to the charge collection and resupply circuit. In the latter case, the DC level shift circuit can be configured to include: a coupling and DC blocking capacitor connected between the charge collection and resupply circuit and the common electrode; a first bias voltage generation resistor connected between the common electrode and a first power supply; and a second bias voltage generation resistor connected between the common electrode and a second power supply.

THE PREFERRED EMBODIMENTS OF THE INVENTION

Preferred embodiments of the invention will be explained in detail below with reference to the attached drawings.

Figure 1:
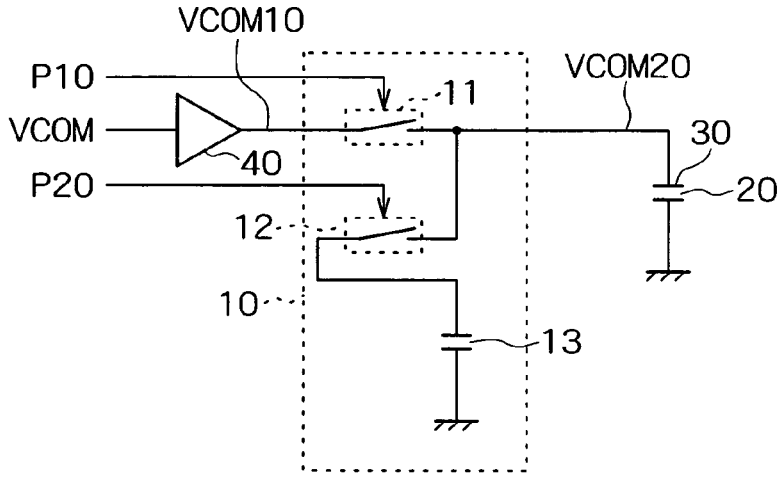
FIG. 1 is a circuit diagram illustrating a liquid crystal display device according to a first embodiment of the invention.
Figure 2:
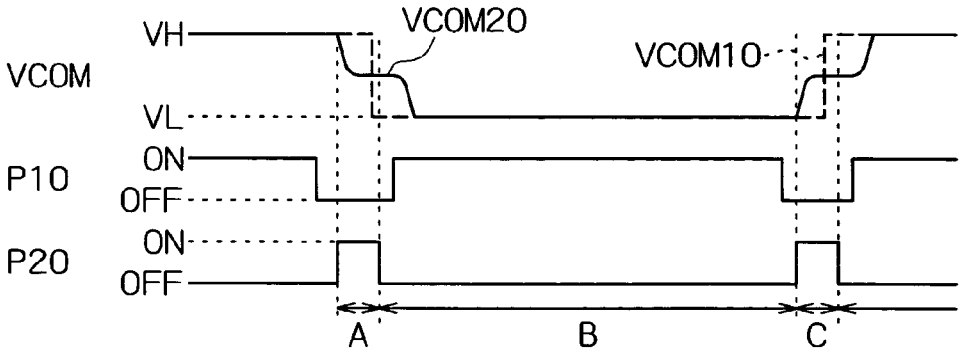
FIG. 2 is a timing chart diagram illustrating how the circuit employed in the first embodiment operates.

FIG. 1 is a circuit diagram showing a charge collection/resupply circuit 10 of a liquid crystal display device according to a first embodiment of the invention and FIG. 2 is a timing chart diagram illustrating how the circuit 10 operates. The liquid crystal display device of the embodiment is an active matrix liquid crystal display device in which the polarity of a voltage on a common electrode is inverted by row or by frame. Referring to FIG. 1, a common voltage output buffer 40 outputs a common voltage VCOM10 to a common electrode 30. The common voltage VCOM10 is inverted between a positive voltage VH and a negative voltage VL at specific time points, as shown by a dashed line of FIG. 2. Added to the common electrode 30 is a panel capacitor 20 associated with the common electrode. In the embodiment, a charge collection/resupply circuit 10 is connected between the common voltage output buffer 40 and the common electrode 30.

The charge collection/resupply circuit 10 is constructed such that a switch 12 and a charge collection capacitor 13 are connected in series between the common electrode 30 and ground. Furthermore, a switch 11 is connected between a connection point of the switch 12 and the common electrode 30 and an output terminal of the common voltage output buffer 40. The switch 11 is switched between on and off states by a control signal P10 dedicated to the switch 11 to be switched and the switch 12 is switched between on and off states by a control signal P20 dedicated to the switch 12 to be switched. The switches 11, 12 are an analog switch constructed by connecting an N-channel transistor and a P-channel transistor in parallel with each other.

Figure 6:
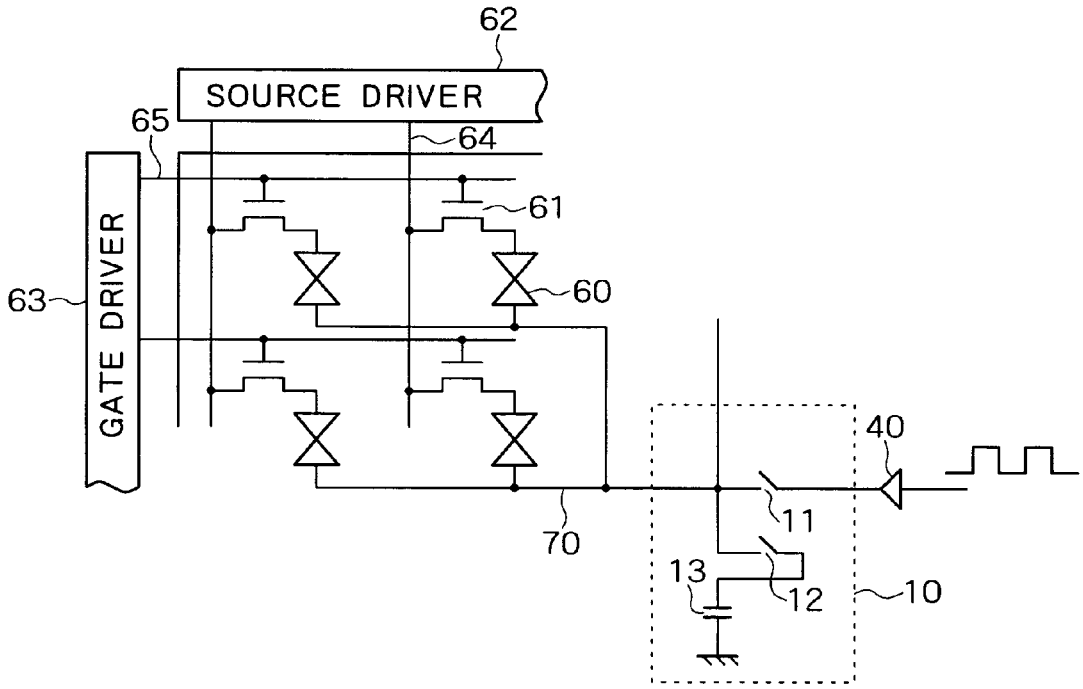
FIG. 6 illustrates a primary portion of an active matrix liquid crystal display device to which the charge collection/resupply circuit 10 of the first embodiment is connected.

It should be noted that FIG. 6 illustrates a primary portion of an active matrix liquid crystal display device to which the charge collection/resupply circuit 10 is connected and in which the polarity of a voltage on a common electrode is inverted by row or by frame. Pixel electrodes are arranged in a matrix of rows and columns and each of the pixel electrodes constitutes a liquid crystal display element 60, and the drain of a Thin Film Transistor (TFT) 61 as a switching element is connected to each of the pixel electrodes. The liquid crystal display element 60 and the thin film transistor 61 constitute each of pixels arranged in a matrix of rows and columns. Additionally, the thin film transistors 61 arranged in a row direction have their gates connected to a gate driver 63 via one scanning line 65 and the thin film transistors 61 arranged in a column direction have their sources connected to a source driver 62 via one signal line 64. Moreover, each of the liquid crystal display elements 60 is configured to have a common electrode 70 disposed to face the pixel electrode via a liquid crystal. Furthermore, the liquid crystal display elements 60 operate such that the transistor 61 selected by a scanning signal from the gate driver 63 is turned on and a voltage supplied by the source driver 62 is applied between the pixel electrode and the common electrode 70 of the liquid crystal display element 60 corresponding to the pixel whose transistor is being selected, allowing the selected liquid crystal display element 60 to emit light. In the embodiment, connected to the common electrode 70 is the charge collection/resupply circuit 10.

Figure 7:
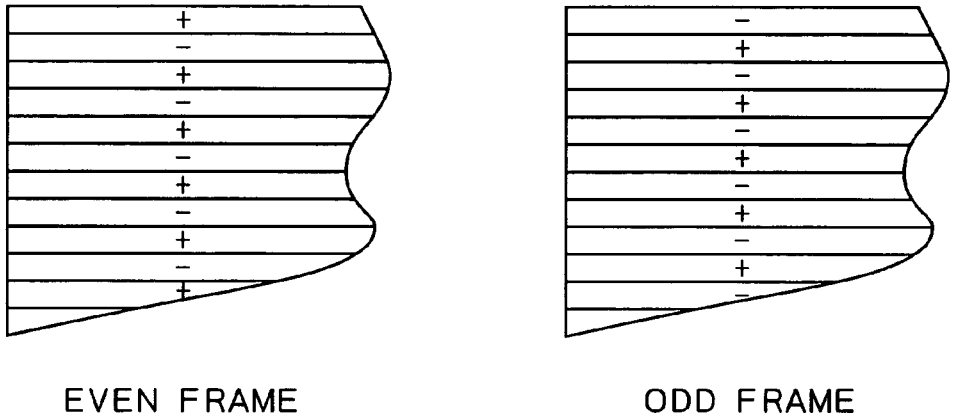
FIG. 7 is a diagram schematically illustrating how inversion by row is performed.
Figure 8:
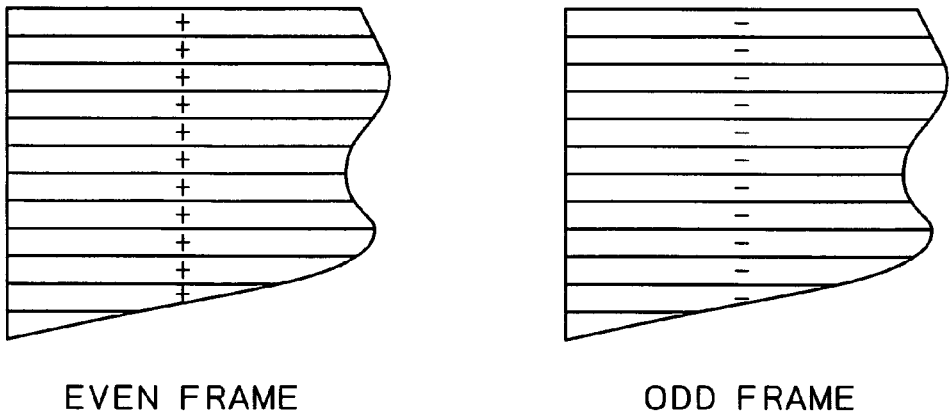
FIG. 8 is a diagram schematically illustrating how inversion by frame is performed.

It should be noted that FIG. 7 is a diagram schematically illustrating how inversion by row is performed and FIG. 8 is a diagram schematically illustrating how inversion by frame is performed. In the former inversion, the polarity of a voltage on a common electrode is inverted by row during each even frame and each odd frame, and in the latter inversion, the polarity of a voltage on a common electrode is inverted by frame during each even frame or each odd frame.

Subsequently, how the liquid crystal display device constructed as described above operates will be explained. In the description of the embodiment, it is assumed that the common voltage VCOM is inverted between a positive polarity VH and a negative polarity VL under the relationship, $0 \leqq VL \leqq VH$, and further, as to how an output waveform of the common voltage VCOM is to be represented, a waveform of a voltage output from a stage prior to the switch 11 is denoted by VCOM 10 and a waveform of a voltage output from a stage subsequent to the switch 11 is denoted by VCOM 20. As indicated by the dashed line of FIG. 2, the common voltage VCOM 10 output from the common voltage output buffer 40 varies. That is, the common voltage VCOM 10 is inverted from a positive polarity VH to a negative polarity VL by row or by frame and further inverted from the negative polarity VL to the positive polarity VH, and this operation is repeated. Furthermore, the switch 11 is turned on and while the positive polarity voltage VH is being output from the common voltage output buffer 40, electric charge equivalent to VH is accumulated in a panel capacitor 20 associated with the common electrode.

Thereafter, immediately before the common voltage VCOM10 output from the common voltage output buffer 40 is inverted from a positive polarity to a negative polarity, the switch 11 is turned off by a control signal P10. Then, the common electrode 30 is separated from the common voltage output buffer 40 and placed in an open state, thereby allowing the panel capacitor to maintain the positive polarity voltage VH across the panel capacitor. Thereafter, the switch 12 is turned on by a control signal P20. Then, the panel capacitor 20 associated with the common electrode 30 becomes connected in parallel with the charge collection capacitor 13. Electric charge accumulated in the panel capacitor associated with the common electrode 30 during a period (charge collection period) A over which the switch 12 is being turned on is released into the charge collection capacitor 13 until the common electrode 30 and the terminal, connected to the common electrode, of the charge collection capacitor 13 come to have the same potential. Thus, the electric charge accumulated in the panel capacitor 20 associated with the common electrode is collected by the charge collection capacitor 13 and the potential (common voltage) VCOM20 (denoted by a solid line of FIG. 2) of the common electrode 30 is reduced down to a level where voltages across the charge collection capacitor 13 and the panel capacitor 20 associated with the common electrode are balanced with each other.

During the charge collection period A, the common voltage VCOM10 (denoted by a dashed line) output from the common voltage output buffer 40 has its polarity inverted and the potential corresponding to the common voltage VCOM10 changes from the positive polarity VH to the negative polarity VL. After the charge collection period A, the switch 12 is turned off. Then, the charge collection capacitor 13 is separated from the common electrode 30 in a situation in which the capacitor 13 has collected the electric charge from the panel capacitor 20 associated with the common electrode 30 and becomes an open circuit, thereby maintaining across the capacitor 13 the voltage that is determined upon completion of collection of electric charge. Thereafter, the switch 11 is turned on. The common electrode 30, in turn, comes to be connected to the common voltage output buffer 40 and the negative polarity voltage VL is applied to the common electrode 30. At this time, the electric charge that has not been collected by the charge collection capacitor 13 and is left in the panel capacitor 20 associated with the common electrode is released. This causes a potential VCOM20 of the common electrode 30 to take a final negative polarity value VL as a fractional value of the common voltage VCOM.

Subsequently, immediately before the common voltage VCOM10 output from the common voltage output buffer 40 is inverted from a negative polarity to a positive polarity, the switch 11 is turned off. Then, the common electrode 30 is separated from the common voltage output buffer 40 and placed in an open state, thereby allowing the panel capacitor to maintain the negative polarity voltage VL across the panel capacitor. Thereafter, the switch 12 is turned on. Then, the panel capacitor 20 associated with the common electrode 30 becomes connected in parallel with the electric charge collection capacitor 13. During a period (charging period) C over which the switch 12 is being turned on, the electric charge accumulated in the electric charge collection capacitor 13 is released into the panel capacitor 20 associated with the common electrode 30 until the common electrode 30 and the terminal, connected to the common electrode, of the charge collection capacitor 13 come to have the same potential. During the charging period C, the electric charge accumulated in the charge collection capacitor 13 is transferred to the panel capacitor 20. Thus, the potential VCOM20 of the common electrode 30 is raised to a level where voltages across the charge collection capacitor 13 and the panel capacitor 20 associated with the common electrode 30 are balanced with each other.

During the charging period C, the common voltage VCOM10 (denoted by a dashed line) is inverted from the negative polarity VL to the positive polarity VH. After the charge resupply period C, the switch 12 is turned off. Then, the common electrode 30 is separated from the charge collection capacitor 13 in a situation in which the charge collection capacitor 13 has resupplied the electric charge to the panel capacitor 20 associated with the common electrode 30 and placed in an open state, thereby allowing the panel capacitor 20 to maintain across the capacitor 20 the voltage that is determined upon completion of resupply of the electric charge.

Subsequently, the switch 11 is turned on. The common electrode 30, in turn, comes to be connected to the common voltage output buffer 40 and the positive polarity voltage VH is applied to the common electrode 30. Thus, the amount of shortage of electric charge, i.e., the difference between the amount of the electric charge, which has been transferred from the charge collection capacitor 13 to the panel capacitor 20, and the amount of the electric charge corresponding to the positive polarity voltage VH, is transferred to the panel capacitor 20 associated with the common electrode 30. This causes the potential VCOM20 of the common electrode 30 to take a final positive polarity value VH as a fractional value of the common voltage VCOM20.

Repeating the above-described operation allows the electric charge accumulated once in the panel capacitor 20 associated with the common electrode to be collected by the charge collection capacitor 13 and resupplied therefrom to the panel capacitor 20 associated with the common electrode, resulting in reduction in power consumption during device operation.

When assuming the above-described collection/resupply operation is one cycle, a voltage $V_n$ appearing on the common electrode 30 after the collection/resupply operation is repeated n cycles is calculated as follows.

If the collection/resupply operation is repeated (n−1) cycles, the amount of electric charge $QP_{n-1}$ accumulated in the panel capacitor 20 associated with the common electrode and the amount of electric charge $Qr_{n-1}$ accumulated in the charge collection capacitor 13 at the time the switch 11 is turned off and immediately before the common voltage VCOM is inverted from a positive polarity to a negative polarity are represented by the following equations (1) and (2), respectively.

$$Qp_{n-1}=Cp\cdot VH \tag{1}$$

$$Qr_{n-1}=Cr\cdot V_{n-1} \tag{2}$$

where Cp is a capacitance value of the panel capacitor 20 associated with the common electrode, Cr is a capacitance value of the charge collection capacitor 13, and $V_{n-1}$ is a voltage across the charge collection capacitor 13 after the collection/resupply operation is repeated n−1 cycles.

It should be noted that when the switch 12 is turned on and the panel capacitor 20 associated with the common electrode 30 and the charge collection capacitor 13 become connected in parallel with each other, the amount of electric charge accumulated in the charge collection capacitor 13 is represented by the following equation (3). In this case, a voltage corresponding to the electric charge collected by the charge collection capacitor 13 is assumed to be $V'_n$.

$$V'_n=(Qr_{n-1}+Qp_{n-1})/(Cp+Cr) \quad (3)$$

When equations (1) and (2) are substituted into equation (3), the following equation (4) results.

$$V'_n=(1/(Cp+Cr))(Cp\cdot VH+Cr\cdot V_{n-1}) \quad (4)$$

Subsequently, the voltage $V_n$ appearing across the charge collection capacitor 13 when the switch 11 is turned off and the switch 12 is turned on after the common electrode voltage is changed to have the negative polarity VL is represented by the following equation (5).

$$V_n=(1/(Cp+Cr))(CpVL+CrV'_n) \quad (5)$$

When equation (4) is substituted into equation (5), the following equation (6) results.

$$V_n=(1/(Cp+Cr))((Cr/(Cp+Cr))(Cp\cdot VH+Cr\cdot V_{n-1})+CpVL) \quad (6)$$

Since the difference between $V_n$ and $V_{n-1}$ becomes smaller with the increase in the integer n, if n=∞, $V_n \approx V_{n-1}$. When this equation is substituted into equation (6), the following equation (7) results.

$$V_n=(1/(2Cr+Cp))(CrVH+(Cp+Cr)VL) \quad (7)$$

Subsequently, the degree to which power consumed by the liquid crystal display device according to the invention is reduced is determined. Consumed power P is generally represented by the following equation (8).

$$P=C\cdot V^2\cdot f \quad (8)$$

It should be noted that C is capacitance, V is amplitude of voltage swing and f is frequency. Through use of the above-described equation (8), power $P_0$ consumed by a liquid crystal display device that is not constructed in accordance with the invention is represented by the following equation (9).

$$P_0=Cp\cdot(VH-VL)^2\cdot f \quad (9)$$

On the other hand, power P consumed by the liquid crystal display device that is constructed in accordance with the invention is represented by the following equation (10).

$$P=Cp\cdot(VH-V_n)^2\cdot f \quad (10)$$

When equation (7) is substituted into equation (10), the following equation (11) results.

$$P=Cp\cdot(VH-(1/(2Cr+Cp))(CrVH+(Cp+Cr)VL))^2\cdot f \quad (11)$$

To help understand the difference between power consumed by the above-described two liquid crystal display devices, the negative polarity voltage VL is assumed to be zero. In this case, equations (9) and (10) are represented by the following equations (12) and (13), respectively.

$$P_0=Cp(VH)^2\cdot f \quad (12)$$

$$P=Cp\cdot(VH-(1/(2Cr+Cp))(CrVH))^2\cdot f \quad (13)$$

Then, when equation (12) is substituted into equation (13), the following equation (14) results.

$$P=P_0\cdot((Cr+Cp)/(2Cr+Cp))^2 \quad (14)$$

If Cr=Cp, the following equation (15) is obtained through use of the above-described equation (14).

$$P=(4/9)P_0 \quad (15)$$

On the other hand, if Cr>>Cp (Cr is far greater than Cp), the following equation (16) results.

$$P=(1/4)\cdot P_0 \quad (16)$$

As can be seen from the equation (16), the power consumed by the liquid crystal display device constructed in accordance with the invention can be reduced down to the minimum, i.e., one fourth of the power consumed by the liquid crystal display device that is not constructed in accordance with the invention.

Figure 3:
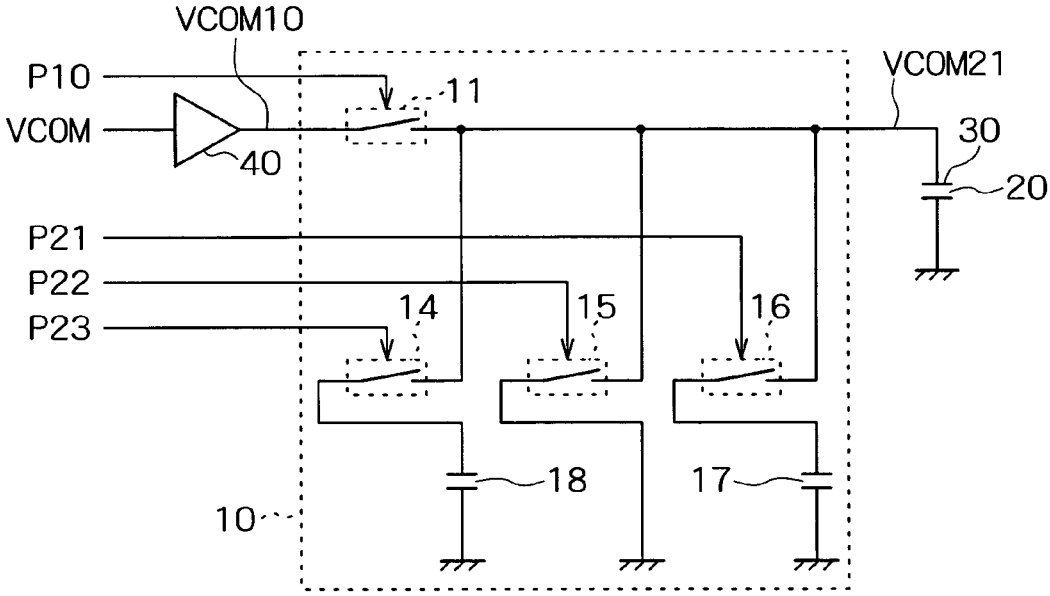
FIG. 3 is a circuit diagram illustrating a liquid crystal display device according to a second embodiment of the invention.
Figure 4:
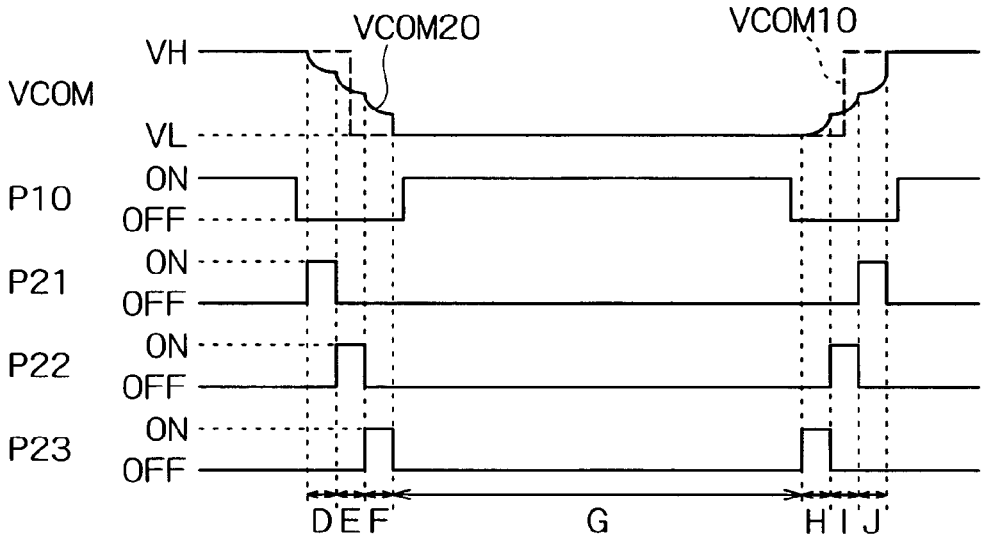
FIG. 4 is a timing chart diagram illustrating how the circuit employed in the second embodiment operates.

Subsequently, a second embodiment of the invention will be explained. FIG. 3 is a circuit diagram illustrating a liquid crystal display device according to the second embodiment of the invention and FIG. 4 is a timing chart illustrative of how the liquid crystal display device operates. Provided between a common electrode 30 and a common voltage output buffer 40 is a charge collection/resupply circuit 10. Moreover, added to the common electrode 30 is a panel capacitor 20 associated with the common electrode. The charge collection/resupply circuit 10 comprises a switch 11, switch 14, switch 15, switch 16, a positive charge collection capacitor 17 and a negative charge collection capacitor 18.

The switch 11 is switched between on and off states by a control signal P10 dedicated to the switch 11 to be switched, the switch 14 is switched between on and off states by a control signal P23 dedicated to the switch 14 to be switched, the switch 15 is switched between on and off states by a control signal P22 dedicated to the switch 15 to be switched, and the switch 16 is switched between on and off states by a control signal P21 dedicated to the switch 16 to be switched.

Subsequently, how the liquid crystal display device according to the embodiment operates will be explained. FIG. 4 is an illustration of how the switch 11, switch 14, switch 15 and switch 16 operate and a common voltage VCOM varies. In the description of the embodiment, it is assumed that the common voltage VCOM is inverted between a positive polarity VH and a negative polarity VL under the relationship, VH≧0 and VL≦0, and further, as to how an output waveform of the common voltage VCOM is to be represented, a waveform of a voltage output from a stage prior to the switch 11 is denoted by VCOM 10 and a waveform of a voltage output from a stage subsequent to the switch 11 is denoted by VCOM 21.

As shown in FIG. 4, while the positive polarity voltage VH is being applied to the common electrode 30, the switch 11 is turned off immediately before the common voltage VCOM is inverted from the positive polarity VH to the negative polarity VL. Then, the common electrode 30 is separated from the common voltage output buffer 40 and placed in an open state, thereby allowing a panel capacitor 20 to maintain the positive polarity voltage VH across the capacitor 20.

Thereafter, the switch 16 is turned on. Then, the panel capacitor 20 associated with the common electrode 30 becomes connected in parallel with the positive charge collection capacitor 17. During a period (charge collection period) D over which the switch 16 is being turned on, the electric charge accumulated in the panel capacitor 20 associated with the common electrode 30 flows into the positive charge collection capacitor 17 while being transferred to the positive charge collection capacitor 17 until the common electrode 30 and the terminal, connected to the common electrode, of the positive charge collection capacitor 17 come to have the same potential.

After the charge collection period D, the switch 16 is turned off. Then, the positive charge collection capacitor 17 is separated from the common electrode 30 in a situation in which the capacitor 17 has collected the electric charge from the panel capacitor 20 associated with the common electrode 30 and becomes an open circuit, thereby maintaining across the capacitor 17 the voltage that is determined upon completion of collection of electric charge.

Thereafter, the switch 15 is turned on. The electric charge left in the panel capacitor 20, in other words, the electric charge that has not been collected by the charge collection capacitor 17 is discharged to ground potential.

Subsequently, the switch 15 is turned off and the switch 14 is turned on. Then, the panel capacitor 20 associated with the common electrode 30 comes to be connected in parallel with the negative charge collection capacitor 18. During a period (charge resupply period) F over which the switch 14 is being turned on, the negative electric charge accumulated in the negative charge collection capacitor 18 flows into the common electrode 30 while being transferred to the panel capacitor 20 until the common electrode 30 and the terminal, connected to the common electrode, of the negative charge collection capacitor 18 come to have the same potential.

It should be appreciated that during the periods D through F, the common voltage VCOM is inverted from the positive polarity VH to the negative polarity VL.

After the charge resupply period F, the switch 14 is turned off. Then, the negative charge collection capacitor 18 is separated from the common electrode 30 in a situation in which the negative charge collection capacitor 18 has resupplied the negative electric charge to the panel capacitor 20 associated with the common electrode 30 and becomes an open circuit, thereby maintaining across the capacitor 18 the voltage that is determined upon completion of resupply of negative electric charge.

Subsequently, the switch 11 is turned on. The common electrode 30, in turn, comes to be connected to the common voltage output buffer 40 and the negative polarity voltage VL is applied to the common electrode 30. At this time, the amount of shortage of negative electric charge, i.e., the difference between the amount of the negative electric charge, which has been transferred from the negative charge collection capacitor 18 to the panel capacitor 20, and the amount of the negative electric charge corresponding to the negative polarity voltage VL, is transferred to the panel capacitor 20 associated with the common electrode until a voltage appearing on the common electrode becomes equal to the negative polarity voltage VL.

Subsequently, while the negative polarity voltage VL is being applied to the common electrode 30, the switch 11 is turned off immediately before the common voltage VCOM is inverted from the negative polarity VL to the positive polarity VH. Then, the common electrode 30 is separated from the common voltage buffer 40 and placed in an open state, allowing the panel capacitor 20 to maintain the negative polarity voltage VL across the capacitor 20.

Subsequently, the switch 14 is turned on. The panel capacitor 20 associated with the common electrode 30, in turn, comes to be connected in parallel with the negative charge collection capacitor 18. During a period (negative charge collection period) H over which the switch 14 is being turned on, the negative electric charge accumulated in the panel capacitor 20 associated with the common electrode 30 flows into the negative charge collection capacitor 18 while being transferred to the capacitor 18 until the common electrode 30 and the terminal, connected to the common electrode, of the negative charge collection capacitor 18 come to have the same potential.

After the negative charge collection period H, the switch 14 is turned off. Then, the negative charge collection capacitor 18 is separated from the common electrode 30 in a situation in which the capacitor 18 has collected the negative electric charge from the panel capacitor 20 associated with the common electrode 30 and becomes an open circuit, maintaining across the capacitor 18 the voltage that is determined upon completion of collection of negative electric charge.

Subsequently, the switch 15 is turned on. Then, the negative electric charge that has not been collected by the negative charge collection capacitor 18 and is left in the panel capacitor 20 is discharged to ground potential.

Thereafter, the switch 15 is turned off and the switch 16 is turned on. Then, the panel capacitor 20 associated with the common electrode 30 becomes connected in parallel with the positive charge collection capacitor 17. During a period (charge resupply period) J over which the switch 16 is being turned on, the electric charge accumulated in the positive charge collection capacitor 17 is released into the panel capacitor 20 associated with the common electrode 30 until the common electrode 30 and the terminal, connected to the common electrode, of the positive charge collection capacitor 17 come to have the same potential.

It should be appreciated that during the periods H through J, the common voltage VCOM is inverted from the negative polarity VL to the positive polarity VH.

After the charge resupply period J, the switch 16 is turned off. Then, the common electrode 30 is separated from the positive charge collection capacitor 17 in a situation in which the electric charge has been resupplied from the positive charge collection capacitor 17 to the panel capacitor 20 and placed in an open state, allowing the panel capacitor 20 to maintain across the capacitor 20 the voltage that is determined upon completion of resupply of electric charge.

Subsequently, the switch 11 is turned on. The common electrode 30, in turn, comes to be connected to the common voltage output buffer 40 and the positive polarity voltage VH is applied to the common electrode 30. At this time, the amount of shortage of electric charge, i.e., the difference between the amount of the electric charge, which has been transferred from the positive charge collection capacitor 17 to the panel capacitor 20, and the amount of the electric charge corresponding to the positive polarity voltage VH, is transferred to the panel capacitor.

The above-described operation is repeated to collect the electric charge accumulated in the panel capacitor 20 associated with the common electrode and then resupply the collected charge.

Figure 5:
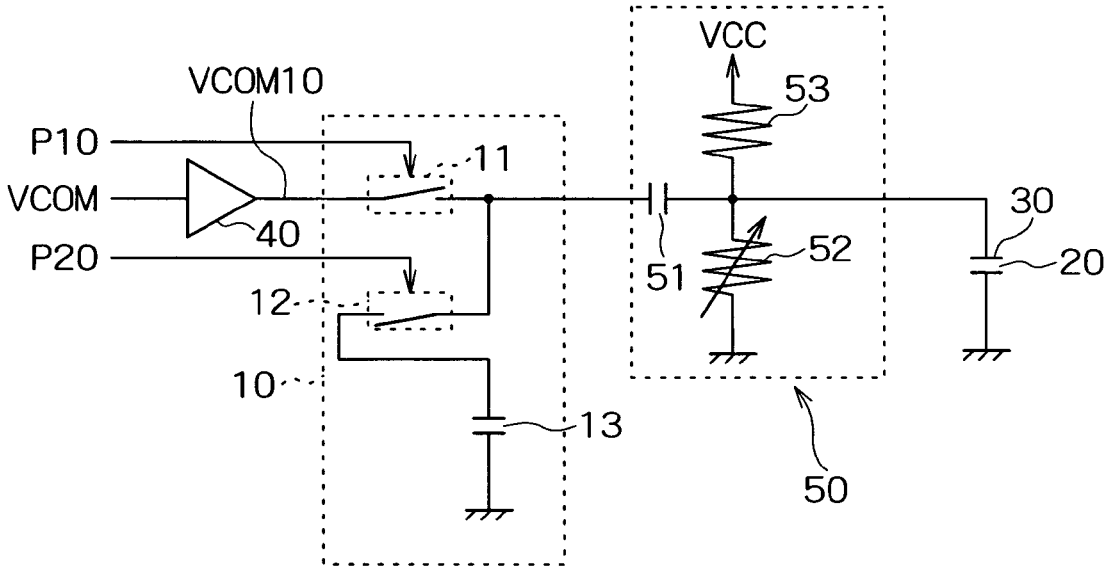
FIG. 5 is a circuit diagram illustrating a liquid crystal display device according to a third embodiment of the invention.

Subsequently, a third embodiment of the invention will be explained. FIG. 5 is a circuit diagram illustrating a liquid crystal display device according to the third embodiment of the invention. In an active matrix liquid crystal display device in which the polarity of a voltage on a common electrode is inverted by row or by frame, a common electrode is biased to a desired operating point by a DC level shift circuit. In the above-described first and second embodiments, a DC level shift circuit (not shown in FIGS. 1 and 3) for biasing a common electrode is disposed in a stage prior to a charge collection/resupply circuit 10. In contrast, in the third embodiment, a DC level shift circuit 50 is disposed in a stage subsequent to a charge collection/resupply circuit 10.

The DC level shift circuit 50 comprises a coupling and DC blocking capacitor 51 and bias voltage generation resistors 52, 53. In this circuit configuration, a common voltage VCOM20 is set to satisfy VH≧VL≧0 and a bias voltage can optionally be determined by the DC level shift circuit 50 disposed in a stage subsequent to the charge collection/resupply circuit 10.

In the DC level shift circuit 50, the coupling and DC blocking capacitor 51 is designed to have a capacitance sufficiently larger than that of a panel capacitor 20 associated with the common electrode and therefore, when the common voltage VCOM20 changes, the coupling and DC blocking capacitor 51 becomes short-circuited. Furthermore, in a case where the bias voltage generation resistors 52, 53 are designed to have a sufficiently large resistance, current flowing through the bias voltage generation resistors 52, 53 can be made negligible upon change in the common voltage VCOM20. Accordingly, the circuit employed in the third embodiment becomes theoretically equivalent to the circuit of FIG. 1, producing beneficial effects similar to those obtained by employment of the first embodiment.

As described in detail so far, according to the invention, when the polarity of a voltage on the common electrode is inverted by row or by frame, the electric charge accumulated in the panel capacitor associated with the common electrode is collected before inversion of the polarity and the collected charge is transferred to the panel capacitor associated with the common electrode after inversion of the polarity, thereby allowing significant reduction in current used to drive a liquid crystal display element. Moreover, in the invention, since the electric charge transferred to the panel capacitor associated with the common electrode is collected and resupplied without through a capacitor and a TFT of the liquid crystal display element, collection ratio of energy within the liquid crystal display device advantageously becomes high. Thus, employment of the present invention makes it possible to provide an active matrix liquid crystal display device suitable for use in a portable terminal monitor as a display device.

What is claimed is:

1. An active matrix liquid crystal display device configured to invert a polarity of a voltage on a common electrode by row or by frame, comprising:

a common voltage supply circuit provided to supply a common voltage to said common electrode; and a charge collection and resupply circuit connected between said common electrode and said common voltage supply circuit, said charge collection and resupply circuit comprising:

a first switch connected between said common electrode and said common voltage supply circuit;

a charge collection capacitor;

a second switch connected between a connection point of said common electrode and said first switch and said charge collection capacitor;

a switch control unit provided to control turning on and off of said first and second switches, said switch control unit being configured to operate such that immediately before a polarity of said common voltage is inverted, said first switch is turned off and said first switch is turned on substantially immediately after inversion of the polarity of said common voltage and wherein said second switch is turned on after said first switch is turned off and said second switch is turned off before said first switch is turned on.

2. An active matrix liquid crystal display device configured to invert a polarity of a voltage on a common electrode by row or by frame, comprising:

a common voltage supply circuit provided to supply a common voltage to said common electrode; and a charge collection and resupply circuit connected between said common electrode and said common voltage supply circuit, said charge collection and resupply circuit comprising:

a first switch connected between said common electrode and said common voltage supply circuit;

a positive charge collection capacitor;

a negative charge collection capacitor;

a second switch connected between a connection point of said common electrode and said first switch and said positive charge collection capacitor;

a third switch connected between said connection point and ground;

a fourth switch connected between said connection point and said negative charge collection capacitor; and a switch control unit provided to control turning on and off of said first through fourth switches, said switch control unit being configured to operate such that immediately before a polarity of said common voltage is inverted from a positive polarity to a negative polarity, said first switch is turned off and then said second switch is turned on and held in an on-state during a specific period of time and then said polarity is inverted while said third switch is being in an on-state during a specific period of time, and subsequently, after said fourth switch is being in an on-state during a specific period of time, said first switch is turned on, and immediately before said common voltage is inverted from a negative polarity to a positive polarity, said first switch is turned off and then said fourth switch is turned on and held in an on-state during a specific period of time, and then, said polarity is inverted while said third switch is being in an on-state during a specific period of time, and thereafter, said second switch is turned on and held in an on-state during a specific period of time and then said first switch is turned on.

3. The liquid crystal display device according to claim 1, further comprising a DC level shift circuit provided to invert a polarity of a common voltage and disposed in a stage prior to said charge collection and resupply circuit.

4. The liquid crystal display device according to claim 2, further comprising a DC level shift circuit provided to invert a polarity of a common voltage and disposed in a stage prior to said charge collection and resupply circuit.

5. The liquid crystal display device according to claim 1, further comprising a DC level shift circuit provided to invert a polarity of a common voltage and disposed in a stage subsequent to said charge collection and resupply circuit.

6. The liquid crystal display device according to claim 2, further comprising a DC level shift circuit provided to invert a polarity of a common voltage and disposed in a stage subsequent to said charge collection and resupply circuit.

7. The liquid crystal display device according to claim 5, wherein said DC level shift circuit includes:

a coupling and DC blocking capacitor connected between said charge collection and resupply circuit and said common electrode;

a first bias voltage generation resistor connected between said common electrode and a first power supply; and a second bias voltage generation resistor connected between said common electrode and a second power supply.

8. The liquid crystal display device according to claim 6, wherein said DC level shift circuit includes:

a coupling and DC blocking capacitor connected between said charge collection and resupply circuit and said common electrode;

a first bias voltage generation resistor connected between said common electrode and a first power supply; and a second bias voltage generation resistor connected between said common electrode and a second power supply.

* * * * *